US006410154B2

(12) United States Patent
Kawaura et al.

(10) Patent No.: US 6,410,154 B2
(45) Date of Patent: Jun. 25, 2002

(54) TIAL-BASED ALLOYS WITH EXCELLENT OXIDATION RESISTANCE, AND METHOD FOR PRODUCING THE SAME

(75) Inventors: Hiroyuki Kawaura; Kazuaki Nishino, both of Seto; Takashi Saito, Nagoya, all of (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 08/952,514

(22) PCT Filed: Mar. 26, 1997

(86) PCT No.: PCT/JP97/01035

§ 371 (c)(1),
(2), (4) Date: Nov. 28, 1997

(87) PCT Pub. No.: WO97/37050

PCT Pub. Date: Oct. 9, 1997

(30) Foreign Application Priority Data

Mar. 29, 1996 (JP) ..... 8-103834
Mar. 29, 1996 (JP) ..... 8-103835
Aug. 29, 1996 (JP) ..... 8-248583

(51) Int. Cl.[7] ..... B32B 9/00

(52) U.S. Cl. ..... 428/472; 148/669; 148/710; 148/421; 148/277; 148/281; 148/284; 428/472.2; 428/701

(58) Field of Search ..... 420/418, 420; 148/669, 710, 421, 277, 281, 284; 428/472, 472.2, 701

(56) References Cited

U.S. PATENT DOCUMENTS 5,372,663 A * 12/1994 Shibue et al. ..... 148/669
5,405,428 A * 4/1995 Dube et al. ..... 148/710

FOREIGN PATENT DOCUMENTS

| | | | |
|---|---|---|---|
| JP | 55-10662 B | | 3/1980 |
| JP | 1-306548 A | | 12/1989 |
| JP | 2294458 A | | 5/1990 |
| JP | 3-75385 A | | 3/1991 |
| JP | 5-78817 A | | 3/1993 |
| JP | 5-78817 | * | 3/1993 |
| JP | 8-41654 | * | 2/1996 |
| JP | 8041654 A | | 2/1996 |

* cited by examiner

*Primary Examiner*—John Sheehan
*Assistant Examiner*—Andrew L. Oltmans
(74) *Attorney, Agent, or Firm*—Oblon, Spivak, McClelland, Maier & Neustadt, P.C.

(57) ABSTRACT

The invention relates to TiAl-base alloys with excellent oxidation resistance, and a method for producing the same. The TiAl-base alloy of the invention comprises a substrate and a surface part formed on the substrate, the surface part comprising at least one element of Cr, Nb, Ta and W and having a surface condition capable of forming a dense film of an oxide of the element or $Al_2O_3$ in high-temperature oxidizing atmospheres. The method of the invention comprises heating a TiAl-base alloy material having an Al content of from 15 at. % to 55 at. % in the presence of an oxide having a smaller negative value of standard free energy of formation than that of alumina. The method of the invention provides TiAl-base alloys with excellent oxidation resistance.

22 Claims, 1 Drawing Sheet

Figure 1:
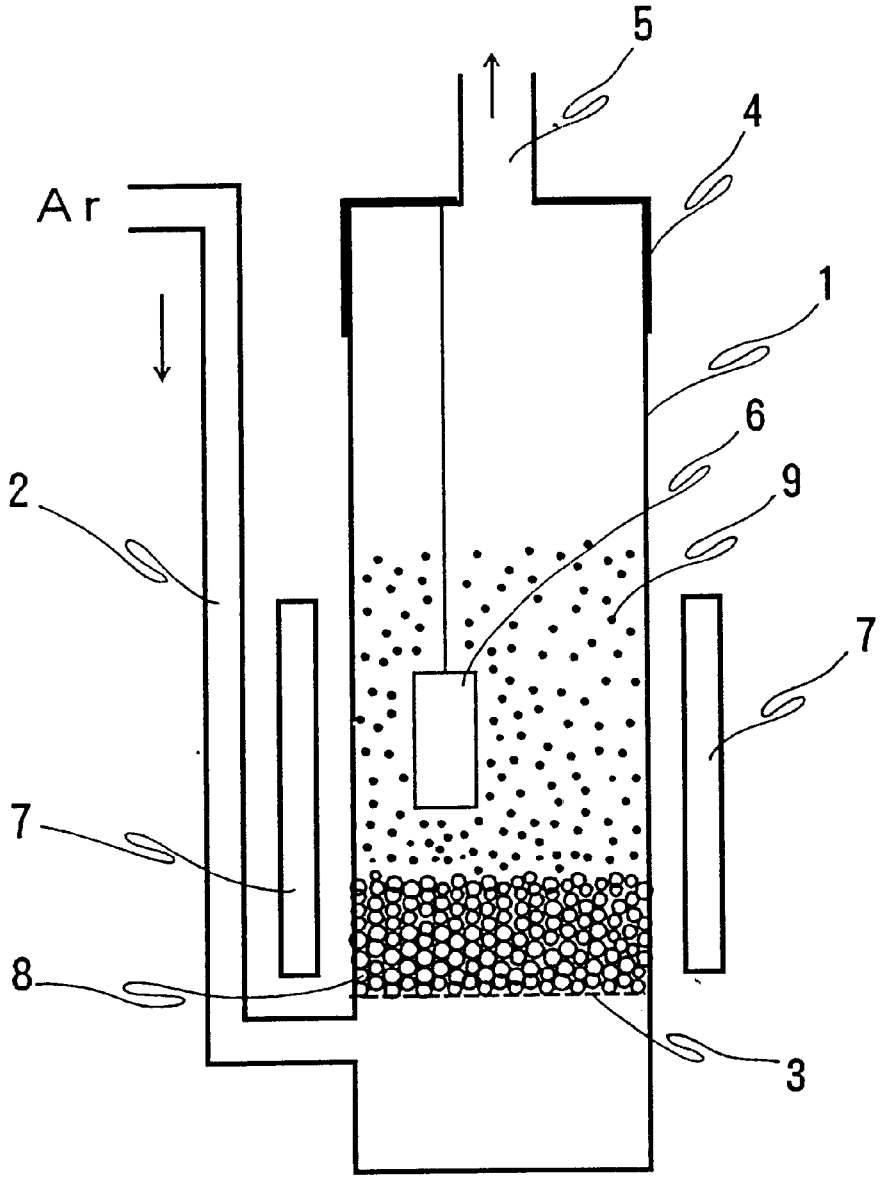

TIAL-BASED ALLOYS WITH EXCELLENT OXIDATION RESISTANCE, AND METHOD FOR PRODUCING THE SAME

TECHNICAL FIELD

The present invention relates to TiAl-base alloys with excellent oxidation resistance, and a method for producing the same.

BACKGROUND ART

TiAl-base alloys are lightweight and have excellent high-temperature strength and creep strength, and the industrialization for practical use of the alloys as lightweight, heat-resistant materials is being promoted. However, there are problems in that the alloys are greatly oxidized when heated at high temperatures in oxidizing atmospheres. Therefore, in order to use such TiAl-base alloys as heat-resistant materials, the improvement in the oxidation resistance of the alloys is indispensable. For this, additions of ternary elements or surface treatments of the alloys are under study.

For example, the additions of ternary elements, such as chromium (Cr), molybdenum (Mo), niobium (Nb), silicon (Si), tantalum (Ta), tungsten (W), etc., to TiAl-base alloys may improve the oxidation resistance of the alloys.

However, the alloys still cannot exhibit satisfactory oxidation resistance in air at high temperatures of 900° C. or higher since their oxidation rate is high under those conditions.

On the other hand, examples of surface treatments of TiAl-base alloys to improve the oxidation resistance, include (1) heat treatment under a low partial pressure oxygen atmosphere, (2) aluminizing, (3) chromizing, etc. However, these are not always effective in view of the adhesion between the matrix and the film formed thereon and in view of the long-term stability of the film.

In order to solve these problems, "TiAl-base intermetallic compound materials and a method for producing the same" (Japanese Patent Application Laid-Open No. 5-78817) have been proposed, which are characterized in that an Mo and or W-rich layer having a thickness of 0.5 $\mu$m or larger is formed on the surface of a TiAl-base intermetallic compound material in the direction of its depth, through sputtering with diffusion coating or through heating in the presence of Mo and/or W oxides optionally followed by diffusion coating. They say that the Mo or W-rich layer formed could promote the formation of an $Al_2O_3$ layer in the lateral direction of the alloy, thereby greatly improving the oxidation resistance of the alloy.

PROBLEMS TO BE SOLVED BY THE INVENTION

However, "TiAl-base intermetallic compound materials and a method for producing the same", disclosed in Japanese Patent Application Laid-Open No. 5-78817 has problems in various points such as those mentioned below. In the TiAl-base intermetallic compound material of that type, much Ti exists in the vicinity of its surface. Therefore, the mere formation of such an Mo and/or W-rich layer on its surface cannot provide a protective film with satisfactory oxidation resistance. Accordingly, in oxidizing atmospheres in air, not only such a protective film of alumina but also $TiO_2$ is formed. $TiO_2$ thus formed grows toward the inside of the substrate, thereby greatly lowering the oxidation resistance of the alloy. For these reasons, it is impossible to form a protective film with satisfactory oxidation resistance on the alloy.

In addition, the disclosed technique requires the adhesion of Mo and/or W followed by diffusion coating to be effected at a temperature between 700° C. and 1450° C., which will unfavorably cause sintering and solidification of the metal powders. Such solidified metal powders will adhere onto the TiAl-base intermetallic compound material.

Moreover, when a TiAl-base intermetallic compound material is heated in the presence of Mo and/or W oxides in a closed vessel, the oxides will also be unfavorably sintered and solidified like the metal powders, causing the same problem in that the thus-solidified oxides will adhere onto the TiAl-base intermetallic compound material. The adhered oxides will react with the TiAl-base intermetallic compound material in oxidizing atmospheres to give products having a low melting point, whereby the oxidation resistance of the material will be rather lowered. In addition, the heat treatment in the closed vessel has problems in point of the producibility.

DISCLOSURE OF THE INVENTION (Objects of the Invention)

An object of the present invention is to provide TiAl-base alloys with excellent oxidation resistance.

Another object of the invention is to provide a method for producing TiAl-base alloys with excellent oxidation resistance.

(Constitution of the Invention)

The method of the present invention for producing TiAl-base alloys with excellent oxidation resistance is characterized in that a TiAl-base alloy material comprising a TiAl-base alloy with an Al content of from 15 at. % to 55 at. % is heated in the presence of an oxide having a smaller negative value of standard free energy of formation than that of alumina.

(Operation of the Invention)

Though as yet not clarified completely, the mechanism of the method of the invention to produce TiAl-base alloys with excellent oxidation resistance may be considered as follows.

First, a TiAl-base alloy material comprising a TiAl-base alloy with an Al content of from 15 at. % to 55 at. % is prepared.

Next, this TiAl-base alloy material is heated in the presence of an oxide having a smaller negative value of standard free energy of formation than that of alumina.

As a result, a TiAl-base alloy is obtained with ease, which comprises a substrate of a TiAl-base alloy with an Al content of from 15 at. % to 55 at. % and a protective film-forming layer with excellent oxidation resistance as formed on the surface of the substrate.

The surface layer of the TiAl-base alloy comprises at least one substance of: an oxide of the element that constitutes the above-mentioned oxide having a smaller negative value of standard free energy of formation than that of alumina; a composite oxide mainly composed of the element or an oxide of the element; and $Al_2O_3$ (alumina). The TiAl-base alloy having the surface layer of that type forms a stable $Al_2O_3$ film, while inhibiting the formation of $TiO_2$ on its surface, in high-temperature oxidizing atmospheres. Accordingly, the oxidation resistance of the TiAl-base alloy is significantly improved.

(Effects of the Invention)

According to the method of the present invention for producing TiAl-base alloys, it is easy to obtain TiAl-base alloys with excellent oxidation resistance.

BRIEF DESCRIPTION OF THE DRAWING [FIG. 1]

FIG. 1 is an explanatory view showing the fluidized bed furnace as used in Example 5 to Example 8 of the present invention.

BEST MODES OF CARRYING OUT THE INVENTION

The First Invention

The first invention is to provide a method for producing TiAl-base alloys with excellent oxidation resistance, which is characterized in that a TiAl-base alloy material comprising a TiAl-base alloy with an Al content of from 15 at. % to 55 at. % is heated in the presence of an oxide having a smaller negative value of standard free energy of formation than that of alumina.

[Preferred Method of The First Invention]

One preferred method of the first invention for producing TiAl-base alloys comprises heating a TiAl-base alloy material comprising a TiAl-base alloy with an Al content of from 15 at. % to 55 at. % in the presence of an oxide comprising tungsten (W) at a temperature falling between 400° C. and 1450° C.

Though as yet not clarified completely, the mechanism of this method of the invention to produce TiAl-base alloys with excellent oxidation resistance may be considered as follows.

First, a TiAl-base alloy material comprising a TiAl-base alloy with an Al content of from 15 at. % to 55 at. % is prepared.

Next, this TiAl-base alloy material is heated in the presence of an oxide comprising tungsten (W) at a temperature falling between 400° C. and 1450° C.

As a result, a TiAl-base alloy is obtained with ease, which comprises a substrate of a TiAl-base alloy with an Al content of from 15 at. % to 55 at. % and a protective film-forming layer with excellent oxidation resistance as formed on the surface of the substrate.

The surface layer of the TiAl-base alloy comprises a composite oxide mainly composed of W or W—O or Al—W—O, or a mixture of the composite oxide and $Al_2O_3$ (alumina). The TiAl-base alloy having the surface layer of that type forms a stable and dense $Al_2O_3$ film, while inhibiting the formation of $TiO_2$ on its surface, in high-temperature oxidizing atmospheres. This $Al_2O_3$ film has good adhesion to the substrate and stably functions as a protective film for a long period of time. Accordingly, the oxidation resistance of the TiAl-base alloy is significantly improved.

The Second Invention

The second invention is to provide a method for producing TiAl-base alloys with excellent oxidation resistance, which is characterized in that a treating reagent comprising an oxide having a smaller negative value of standard free energy of formation than that of alumina and a powdery refractory such as alumina or the like is introduced into a fluidized bed furnace, a fluidizing gas is introduced thereinto to thereby fluidize the treating reagent, and a TiAl-base alloy material having an Al content of from 15 at. % to 55 at. % is disposed and heated in the fluidized bed furnace.

According to the method of the present invention for producing TiAl-base alloys, it is easy to produce TiAl-base alloys with excellent oxidation resistance.

Though as yet not clarified completely, the mechanism of this method of the invention to produce TiAl-base alloys with excellent oxidation resistance may be considered as follows.

First, a treating reagent comprising an oxide having a smaller negative value of standard free energy of formation than that of alumina and a powdery refractory such as alumina or the like are introduced into a fluidized bed furnace.

Next, a fluidizing gas is introduced into the fluidized bed furnace to thereby fluidize the treating reagent, and a TiAl-base alloy material having an Al content of from 15 at. % to 55 at. % is disposed and heated in the fluidized bed furnace.

In this method, since the TiAl-base alloy material is treated under heat with the treating reagent comprising an oxide, which has a smaller negative value of standard free energy of formation than that of alumina, in the fluidized bed furnace, the oxide is sublimed and evaporated during the treatment to form a protective film-forming surface layer with excellent oxidation resistance. The surface layer comprises at least one substance of: an oxide of the element constituting the oxide, which has a smaller negative value of standard free energy of formation than that of alumina; a composite oxide mainly composed of the element or an oxide of the element; and $Al_2O_3$ (alumina).

The TiAl-base alloy having the surface layer of that type forms a stable $Al_2O_3$ film, while inhibiting the formation of $TiO_2$ on its surface, in high-temperature oxidizing atmospheres. Accordingly, the oxidation resistance of the TiAl-base alloy is significantly improved.

Thus, TiAl-base alloys with excellent oxidation resistance can be produced with ease according to the method of the present invention.

[Preferred Method of The Second Invention]

One preferred method of the second invention for producing TiAl-base alloys comprises: introducing a treating reagent comprising a powdery oxide containing tungsten (W) and a powdery refractory such as alumina or the like into a fluidized bed furnace; introducing a fluidizing gas thereinto to thereby fluidize the treating reagent; and disposing and heating a TiAl-base alloy material having an Al content of from 15 at. % to 55 at. % in the fluidized bed furnace.

Though as yet not clarified completely, the mechanism of this method of the invention to produce TiAl-base alloys with excellent oxidation resistance may be considered as follows.

First, a treating reagent comprising a powdery oxide containing tungsten (W) and a powdery refractory such as alumina is introduced into a fluidized bed furnace.

Next, a fluidizing gas is introduced into the fluidized bed furnace to thereby fluidize the treating reagent, and a TiAl-base alloy material having an Al content of from 15 at. % to 55 at. % is disposed and heated in the fluidized bed furnace.

In this method, since the TiAl-base alloy material is treated under heat with the treating reagent comprising a powdery oxide containing tungsten (W) in the fluidized bed furnace, the oxide is sublimed and evaporated during the treatment to produce with ease a TiAl-base alloy comprising a substrate of a TiAl-base alloy having an Al content of from 15 at. % to 55 at. % and a protective film-forming surface layer with excellent oxidation resistance formed on the surface of the substrate.

The surface layer of the TiAl-base alloy comprises a composite oxide mainly composed of W or W—O or Al—W—O, or a mixture of the composite oxide and $Al_2O_3$ (alumina). The TiAl-base alloy having the surface layer of that type forms a stable and dense $Al_2O_3$ film, while inhibiting the formation of $TiO_2$ on its surface, in high-temperature oxidizing atmospheres. This $Al_2O_3$ film has good adhesion to the substrate and stably functions as a protective film for a long period of time. Accordingly, the oxidation resistance of the TiAl-base alloy is significantly improved.

Thus, TiAl-base alloys with excellent oxidation resistance can be produced with ease according to the method of the present invention.

[Preferred Embodiments of The First Invention and The Second Invention]

(TiAl-base Alloy Material)

The TiAl-base alloy material for use in the present invention comprises Al in an amount of from 15 at. % to 55 at. %. Therefore, this may be converted into a TiAl-base alloy with good room-temperature ductility and excellent high-temperature strength. If the Al content of the material is smaller than the defined range, the alloy will have a mixed texture comprising an α-Ti alloy and a $Ti_3Al$ phase, resulting in that its high-temperature strength is lowered. On the other hand, if it is larger than the defined range, the alloy will have a mixed texture comprising a TiAl phase and an $Al_3Ti$ phase thereby to be extremely brittle. It is desirable that the remainder of the TiAl-base alloy material except Al that falls within the defined range consists essentially of Ti.

The TiAl-base alloy material for use in the present invention may be any and every one as prepared, for example, by melting or sintering raw materials in any desired manner followed by processing the resulting melt or sintered body through casting, forging, machining, rolling or the like to make it have any desired shape.

One preferred embodiment of the TiAl-base alloy material for use in the present invention is a TiAl-base alloy comprising Al in an amount of from 15 to 55 at. % and containing at least one element of the Group Va and the Group VIa in a total amount of from 0.1 at. % to 10 at. %. The additional element will improve the ductility and/or high-temperature strength of the matrix of the alloy. However, if the amount of the element is larger than 10 at. %, the TiAl-base alloy could not be lightweight, and would be often unfavorable for some purposes.

Another preferred embodiment of the TiAl-base alloy material for use in the present invention is a TiAl-base alloy comprising Al in an amount of from 15 to 55 at. % and boron in an amount of from 1 at. % to 10 at. %. The additional element, boron, will make the alloy have a fine solid texture while ensuring the room-temperature ductility of the matrix of the alloy. However, if boron is added to the alloy in an amount larger than the defined range, it will lower the ductility of the alloy, resulting in that the alloy would be often unfavorable for some purposes.

Still another preferred embodiment of the TiAl-base alloy material for use in the present invention is a TiAl-base alloy comprising Al in an amount of from 15 to 55 at. %, at least one element of the Group Va and the Group VIa in an amount of from 0.1 at. % to 10 at. % in total, and boron in an amount of from 1 at. % to 10 at. %. The additional elements may improve the ductility and/or high-temperature strength of the matrix of the alloy, while making the alloy have a fine solid texture and ensuring the room-temperature ductility of the matrix of the alloy.

(Oxide Having a Smaller Negative Value of Standard Free Energy of Formation than that of Alumina)

The oxide for use in the present invention is an oxide having a smaller negative value of standard free energy of formation than that of alumina (J. F. Elliot, M. Gleiser: Thermo-chemistry for Steelmaking, Vol. I (1960), Addison-Wesley). Concretely, examples include oxides of at least one of Si (silicon), Ti (titanium), V (vanadium), Cr (chromium), Mn (manganese), Fe (iron), Co (cobalt), Ni (nickel), Cu (copper), Nb (niobium), Mo (molybdenum), Ta (tantalum), W (tungsten), and Ce (cerium). Regarding the morphology of the oxides to be applied to the invention, it is preferable to use fine particles of these oxides or of substances mainly composed of these oxides.

It is more preferable to use fine particles of one or more oxides of at least Nb (niobium), Ta (tantalum), Cr (chromium) and W (tungsten), or fine particles of substances mainly composed of these oxides. This is because these oxides can be easily sublimed during heat treatment to react with Al for oxidation and reduction, through which is formed a surface layer with excellent oxidation resistance.

(Conditions for Heat Treatment)

In the present invention, the heating temperature is selected from the range falling between 400° C. and 1450° C. If it is lower than 400° C., a surface condition with satisfactory oxidation resistance cannot be obtained. On the other hand, if it is higher than 1450° C., such is unfavorable since the material is melted.

More preferably, the heating temperature shall fall between 700° C. and 1150° C. This is because oxides of $Nb_2O_5$, $Ta_2O_5$ and $WO_3$ react to form compounds.

The atmosphere for the heat treatment is preferably an inert gas atmosphere.

(Fluidized Bed Furnace)

The fluidized bed furnace to be used in the present invention may be any and every one capable of realizing the intended treatment of the invention. Any ordinary fluidized bed furnace that is generally used for drying, firing or reduction may be used.

(Treating Reagent)

The treating reagent to be used in the present invention comprises an oxide and a powdery refractory. For the oxide, used is a powder of an oxide having a smaller negative value of standard free energy of formation than that of alumina, or a powder of an oxide comprising tungsten (W). The powdery oxide is to be a substance for forming a protective film with excellent oxidation resistance on the surface of a TiAl-base alloy material, or to be a substance constituting the protective film.

Where an oxide comprising W is used, the surface layer of the heat-treated TiAl-base alloy comprises a composite oxide mainly composed of W or W—O or Al—W—O, or a mixture comprising the composite oxide and $Al_2O_3$ (alumina). The TiAl-base alloy having the surface layer forms a more stable and dense $Al_2O_3$ film, while inhibiting the formation of $TiO_2$ on its surface, in high-temperature oxidizing atmospheres. The resulting $Al_2O_3$ film has good adhesion to the substrate and stably functions as a protective film for a long period of time. Accordingly, the oxidation resistance of the TiAl-base alloy is much more significantly improved.

The powdery refractory is to prevent the powdery oxide from being solidified while the oxide is fluidized. Preferably, the powdery refractory does not react with the powdery oxide, and does not react with the material to be treated. The powdery refractory may be any and every one acting as above, which includes, for example, alumina ($Al_2O_3$ ) and zirconia ($ZrO_2$).

One factor of worsening the oxidation resistance of TiAl-base alloys is that oxygen penetrates into the inside of the matrix of the alloy to be in solid solution, thereby forming internal oxides in the matrix. Of such internal oxides, $TiO_2$ forms oxide scale even in the inside of the matrix, additionally forming composite oxides with $Al_2O_3$ therein. As a result, the matrix shall have a plurality of oxides in plural oxide layers that differ in morphology and in thermal expansion during heating/cooling cycles, resulting in repetitive peeling and dropping of the oxide layers thereby to further lower the oxidation resistance of the alloy.

A specific means of improving the oxidation resistance of TiAl-base alloys is employed in the present invention, which is to produce a surface condition of the alloy capable of inhibiting the formation of $TiO_2$ that may give internal oxides. For this, in one preferred embodiment of the present invention, utilized is an oxide comprising $WO_3$ thereby to form a composite oxide film acting as a protective film and mainly composed of W or W—O or Al—W—O on the surface of the TiAl-base alloy material, by which is inhibited the formation of $TiO_2$ that may penetrate into the inside of the alloy material. The oxide may be a composite oxide containing Ti and/or Al in the matrix of the TiAl-base alloy.

The amount of the powdery oxide is preferably from 5 to 50% by weight of the treating reagent. The amount may be over 50% by weight, provided that the oxide does neither solidify nor adhere onto the material to be treated. However, if the amount is less than 5% by weight, it will be difficult to form a layer to be a protective film with excellent oxidation resistance, such as a composite oxide film comprising W or W—O.

Regarding the particle size of the treating reagent, it is preferable that the particles constituting the reagent fall between 40 mesh-pass ones and 350 mesh-pass ones. If the particles are larger than 40 mesh-pass ones, a large amount of fluidizing gas is needed for fluidizing the treating agent. On the contrary, if the particles are smaller than 350 mesh-pass ones, the treating reagent powder will scatter too much and is difficult to handle.

Depending on the fluidizing and heating conditions, the treating reagent powder will often clog the fluidizing gas inlet to interfere with normal fluidization. In order to evade this, coarse particles (5 to 20 mesh-pass ones) of a refractory such as alumina may be disposed between the gas inlet and the treating reagent powder.

(Fluidizing Gas)

The fluidizing gas for use in the present invention is preferably an inert gas which reacts with neither the treating reagents nor the material being treated while in contact with these. Above all, argon gas of ordinary purity is generally used.

The fluidizing gas is introduced into the fluidized bed furnace under a predetermined pressure and at a predetermined flow rate. As a result, the treating reagent powder is blown upward in the furnace without dropping downward due to the pressure of the fluidizing gas that is continuously introduced into the furnace, resulting in that the powder is floating to form a fluidized bed in the furnace. However, if the flow rate of the fluidizing gas is too small, the treating reagent will often adhere onto the surface of the material being treated. Therefore, it is preferable that the flow rate of the fluidizing gas is not smaller than 2 ml/min. On the contrary, if the flow rate is too large, great fluidization occurs to cause great bubbling in the furnace whereby much labor is needed for the operation. Accordingly, the uppermost limit of the flow rate is preferably 700 ml/min. The pressure of the fluidizing gas is desirably from 0.5 to 2 $kgf/cm^2$ in view of the easiness in handling it.

(Heating Step)

In the heating step of the present invention, a fluidized bed as a heating medium is heated. Any means for heating the fluidized bed furnace may be employed. For example, the fluidized bed furnace having therein the fluidized bed may be inserted into an external heater, such as an electric furnace, and heated by external heat.

The heating temperature is selected from the range falling between 400° C. and 1450° C. If the heating temperature is lower than 400° C., the material treated will not have surface condition with good oxidation resistance. On the other hand, if it is higher than 1450° C., such is unfavorable since the material treated is melted. More preferably, the heating temperature shall fall between 700° C. and 1150° C. This is because oxides of $Cr_2O_3$, $Nb_2O_5$, $Ta_2O_5$ and $WO_3$ react to form compounds.

In order to produce the intended, oxidation-resistant surface condition, the heat-treating time is preferably between 0.5 hours and 20 hours. If the time is shorter than 0.5 hours, the effect of the heat treatment may be poor. However, if it is longer than 20 hours, such is unfavorable since the processing costs are too high.

The atmosphere for the heat treatment is preferably an inert gas atmosphere.

The Third Invention

The third invention is to provide a TiAl-base alloy with excellent oxidation resistance, which is characterized in that it comprises a substrate comprising a TiAl-base alloy and a surface part formed on the substrate, the surface part comprising at least one element of chromium (Cr), niobium (Nb), tantalum (Ta) and tungsten (W) and having a surface condition capable of forming a dense film of an oxide of the element or $Al_2O_3$ in high-temperature oxidizing atmospheres.

The TiAl-base alloy of the invention has excellent oxidation resistance.

Though as yet not clarified completely, the mechanism of the TiAl-base alloy of the invention to exhibit the excellent effects may be considered as follows.

The TiAl-base alloy of the third invention has a surface condition capable of forming a dense film comprising one or more oxides of at least one of chromium (Cr), niobium (Nb), tantalum (Ta) and tungsten (W) or a dense film of $Al_2O_3$ at least on the outermost surface of a TiAl-base alloy material in high-temperature oxidizing atmospheres. The oxide films have good adhesion to the matrix of the alloy, and it is believed that these films function as stable protective films for a long period of time to thereby significantly improve the oxidation resistance of the alloy.

Accordingly, the TiAl-base alloy of the present invention has excellent oxidation resistance.

The TiAl-base alloy of the present invention has, on its surface, a layer of 1 nm or more in thickness that is rich in at least one element of Cr, Nb, Ta and W. The TiAl-base alloy of the present invention also has, on its surface, a stabilized layer of 1 nm or more in thickness that is rich in one or more oxides of at least one of Cr, Nb, Ta and W.

Of the TiAl-base alloy of the present invention having the rich layer, at least the outermost surface (this may comprise the entire rich layer) may be modified to have a thermally-stable $Al_2O_3$.

[Preferred TiAl-base Alloy of The Third Invention]

One preferred TiAl-base alloy of the third invention comprises a substrate comprising a TiAl-base alloy and a surface part comprising tungsten (W) as formed on the surface of the substrate, the surface part having a film of a compound comprising tungsten (W) while having a surface condition capable of forming a dense film of a tungsten oxide or $Al_2O_3$ in high-temperature oxidizing atmospheres.

Of the TiAl-base alloy of that type, the surface part comprising tungsten (W) forms a layered, dense $Al_2O_3$ film in high-temperature oxidizing atmospheres. This $Al_2O_3$ film has good adhesion to the substrate, while acting as a protective film for a long period of time. Therefore, the TiAl-base alloy has excellent oxidation resistance.

The Fourth Invention

The fourth invention is to provide a TiAl-base alloy with excellent oxidation resistance, which is characterized in that it comprises a substrate comprising a TiAl-base alloy and a surface part formed on the substrate, the surface part being a film of an oxide of at least one of chromium (Cr), niobium (Nb), tantalum (Ta) and tungsten (W).

The TiAl-base alloy of the invention has excellent oxidation resistance.

Though as yet not clarified completely, the mechanism of the TiAl-base alloy of the invention to exhibit the excellent effects may be considered as follows.

The TiAl-base alloy of the fourth invention has a surface condition capable of forming a dense film comprising one or more oxides of at least one of chromium (Cr), niobium (Nb), tantalum (Ta) and tungsten (W) or a dense film of $Al_2O_3$ at least on the outermost surface of a TiAl-base alloy material in high-temperature oxidizing atmospheres. The oxide films have good adhesion to the matrix of the alloy, and it is believed that these films function as stable protective films for a long period of time to thereby significantly improve the oxidation resistance of the alloy.

Accordingly, the TiAl-base alloy of the present invention has excellent oxidation resistance.

The TiAl-base alloy of the present invention has, on its surface, a stabilized layer of 1 nm or more in thickness that is rich in one or more oxides of at least Cr, Nb, Ta and W.

Preferably, this TiAl-base alloy of the present invention has, on its surface, a layer of 1 nm or more in thickness that is rich in at least one element of Cr, Nb, Ta and W.

In the TiAl-base alloy of the present invention having the rich layer, at least the outermost surface may be modified to have a thermally-stable $Al_2O_3$.

[Preferred TiAl-base Alloy of The Fourth Invention]

One preferred TiAl-base alloy of the fourth invention comprises a substrate comprising a TiAl-base alloy and a surface part comprising a film of a tungsten oxide as formed on the surface of the substrate.

In the TiAl-base alloy of that type, the tungsten oxide film forms a layered, dense protective film of $Al_2O_3$ or others in high-temperature oxidizing atmospheres. Therefore, the TiAl-base alloy has excellent oxidation resistance.

The Fifth Invention

The fifth invention is to provide a TiAl-base alloy with excellent oxidation resistance, which is characterized in that it comprises a substrate comprising a TiAl-base alloy having an Al content of from 15 at. % to 55 at. %, and a composite oxide mainly composed of Al—W—O as formed on the surface of the substrate.

The TiAl-base alloy of the invention has excellent oxidation resistance.

Though as yet not clarified completely, the mechanism of the TiAl-base alloy of the invention to exhibit the excellent effects may be considered as follows.

The TiAl-base alloy of the fifth invention has a composite oxide mainly composed of Al—W—O as formed on the surface of its substrate. This composite oxide mainly composed of Al—W—O acts, at its lower part (this lower part is in contact with the substrate), to form layers of $Al_2O_3$ while forming a surface condition capable of forming a dense film of $Al_2O_3$ on the outermost surface of the TiAl-base alloy substrate in an oxidizing condition in air. The $Al_2O_3$ film has good adhesion to the matrix of the alloy, and it is believed that the film functions as a stable protective film for a long period of time to thereby significantly improve the oxidation resistance of the alloy.

Accordingly, the TiAl-base alloy of the present invention has excellent oxidation resistance.

The substrate of the invention comprises a TiAl-base alloy having an Al content of from 15 at. % to 55 at. %. If the Al content of the alloy is smaller than 15 at. %, the alloy will have a mixed texture comprising an α-Ti alloy and a $Ti_3Al$ phase, resulting in that its high-temperature strength is lowered. On the other hand, if it is larger than 55 at. %, the alloy will have a mixed texture comprising a TiAl phase and an $Al_3Ti$ phase thereby to be extremely brittle. Accordingly, the Al content of the substrate shall fall between 15 at. % and 55 at. %.

[Preferred TiAl-base Alloy of The Fifth Invention]

One preferred TiAl-base alloy of the fifth invention comprises a substrate comprising a TiAl-base alloy having an Al content of from 15 at. % to 55 at. %, and a surface layer part mainly composed of a composite oxide comprising Al—W—O as formed on the surface of the substrate. As having the surface layer part mainly composed of a composite oxide comprising Al—W—O on the surface of the substrate, the TiAl-base alloy of that type have much more excellent oxidation resistance.

In the TiAl-base alloy of the present invention, the composite oxide preferably contains tungsten (w) in an amount of from 0.5 at. % to 50 at. %. In the TiAl-base alloy of that type, the composite oxide forms a layered, stable protective film of $Al_2O_3$ or others in an oxidizing condition in air.

If the tungsten (W) content of the composite oxide is less than 0.5 at. %, such is unfavorable since the intended protective film could not be formed satisfactorily in a layered structure and since the substrate will be oxidized even to its depths to greatly worsen the oxidation resistance of the alloy. If the W content of the composite oxide is more than 50 at. %, such is also unfavorable for some purposes since the alloy could not be lightweight.

In the TiAl-base alloy of the present invention, the Al—W—O composite oxide existing in its outermost surface shall be formed in a film to cover the substrate. Regarding the thickness of the film of the composite oxide, the film may be thin. Even if the film has a thickness of 1 nm, it is effective in improving the oxidation resistance of the alloy.

Preferred Embodiments of The Third Invention to The Fifth Invention (Substrate)

As the substrate of the present invention, employable is a TiAl-base alloy. Preferred composition of the alloy and the reasons for the composition are mentioned below.

Al: A TiAl-base alloy having an Al content of from 15 at. % to 55 at. % has good room-temperature ductility and excellent high-temperature strength. If the Al content of the alloy is smaller than the defined range, the alloy will have a mixed texture comprising an α-Ti alloy and a $Ti_3Al$ phase, resulting in that its high-temperature strength is lowered. On the other hand, if it is larger than the defined range, the alloy will have a mixed texture comprising a TiAl phase and an $Al_3Ti$ phase thereby to be extremely brittle.

Ti: The remainder of the TiAl-base alloy excepting Al that falls within the defined range consists essentially of Ti.

The TiAl-base alloy for use in the present invention may be any and every one as prepared, for example, by melting or sintering raw materials in any desired manner followed by processing the resulting melt or sintered body through casting, forging, machining, rolling or the like to make it have any desired shape.

<Preferred Substrate 1>

One preferred substrate for the TiAl-base alloy with excellent oxidation resistance of the present invention is a TiAl-base alloy comprising Al in an amount of from 15 to 55 at. % and at least one element of the Group Va (V, Nb, Ta) and the Group VIa (Cr, Mo, W) in an amount of from 0.1 at. % to 10 at. % in total.

The additional element(s) of the Group Va and/or Group VIa, which may be contained in the alloy in an amount of from 0.1 at. % to 10 at. % in total, may ensure the ductility or the high-temperature strength of the substrate of the alloy. However, if the amount of the additional elements is larger than the defined range, the TiAl-base alloy could not be lightweight.

<Preferred Substrate 2>

Another preferred substrate for the TiAl-base alloy with excellent oxidation resistance of the present invention is a TiAl-base alloy comprising Al in an amount of from 15 to 55 at. % and boron in an amount of from 1 at. % to 10 at. %.

The additional boron (B) to be in an amount of from 1 at. % to 10 at. % will make the alloy have a fine solid texture while ensuring the room-temperature ductility of the substrate. However, if boron is added to the alloy in an amount larger than the defined range, it will lower the ductility of the alloy.

<Preferred Substrate 3>

Still another preferred embodiment of the substrate for the TiAl-base alloy with excellent oxidation resistance of the present invention is a TiAl-base alloy comprising Al in an amount of from 15 to 55 at. %, at least one element of the Group Va and the Group VIa in an amount of from 0.1 at. % to 10 at. % in total, and boron in an amount of from 1 at. % to 10 at. %.

(Oxide layer mainly composed of Al—O)

The TiAl-base alloy with excellent oxidation resistance of the present invention is preferably a TiAl-base alloy having an oxide layer mainly composed of Al—O between the substrate and the surface part (or the surface layer part). Having this structure, the TiAl-base alloy has excellent oxidation resistance.

(Preferred Embodiments)

One preferred embodiment of the TiAl-base alloy with excellent oxidation resistance of the present invention is a TiAl-base alloy with excellent oxidation resistance, which comprises a substrate comprising a TiAl-base alloy having an Al content of from 15 at. % to 55 at. %, and an oxide layer mainly composed of Al—O as formed on the surface of the substrate, and which is characterized in that;

It is prepared by oxidizing a TiAl-base alloy material comprising a TiAl-base alloy substrate having an Al content of from 15 at. % to 55 at. %, and a surface layer part mainly composed of one or more oxides of at least one of niobium (Nb), tantalum (Ta), chromium (Cr) and tungsten (W) as formed on the surface of the substrate, in an oxidizing atmosphere to thereby modify the surface layer part into an oxide layer mainly composed of Al—O.

In this embodiment, it is more preferred that the surface of the oxide layer additionally has an oxide mainly composed of W.

EXAMPLES

Example 1

[Material to be Treated]

Sponge titanium having a purity of 99.9% and aluminium having a purity of 99.99% were weighed to have a predetermined composition, and cast into a mold that had been degassed to $10^{-4}$ Torr, through high frequency melting in an Ar atmosphere, to prepare about 1 kg of ingot (Ti-47 at. % Al).

The ingot was cut into tabular test pieces of 10×15×2 (mm) in size. The surface of each test piece was polished with No. 1500 SiC paper, and then degreased with acetone. These test pieces are materials to be treated.

[Surface Treatment]

First, $Cr_2O_3$ powder, $Nb_2O_5$ powder, $Ta_2O_5$ powder or $WO_3$ powder was put into an $Al_2O_3$ crucible, and a material to be treated was embedded in the powder and heated in Ar at from 900 to 1150° C. for 2 hours. Thus were prepared TiAl-base alloys (sample No. 1 to sample No. 12).

Comparative Example 1

The same material as in Example 1 was prepared, which was not subjected to the surface treatment (sample No. C1).

Oxidation Test

The tabular test pieces prepared in Example 1 and Comparative Example 1 were subjected to an oxidation test, from which the oxidation resistance of the test pieces was evaluated. The oxidation test was conducted, using a resistance heating electric furnace, in which the test pieces were heated in air at 900° C. for 200 hours. Each test piece was heated in the furnace while being put in the alumina crucible, and the weight of all the heated residue including the peeled, oxidized scale was measured. From this was obtained the weight increase caused by the oxidation. Based on the weight increase, the oxidation resistance of each test piece was evaluated. The data are shown in Table 1.

As is obvious from Table 1, it is understood that the test pieces of Example 1 all have significantly improved oxidation resistance.

TABLE 1

Data in Oxidation Test for Evaluating Oxidation Resistance

| Sample No. | Oxide | Condition for Heat Treatment: Temperature (° C.) | Condition for Heat Treatment: Time (hour) | Oxidation Test Weight Increase after Oxidation ($mg/cm^2$) |
|---|---|---|---|---|
| Example 1 | | | | |
| 1 | $Cr_2O_3$ | 900 | 2 | 2.2 |
| 2 | $Cr_2O_3$ | 1000 | 2 | 2 |
| 3 | $Cr_2O_3$ | 1150 | 2 | 1.7 |
| 4 | $Nb_2O_5$ | 900 | 2 | 2.3 |
| 5 | $Nb_2O_5$ | 1000 | 2 | 2.0 |
| 6 | $Nb_2O_5$ | 1150 | 2 | 1.8 |
| 7 | $Ta_2O_5$ | 900 | 2 | 1.8 |
| 8 | $Ta_2O_5$ | 1000 | 2 | 1.7 |
| 9 | $Ta_2O_5$ | 1150 | 2 | 1.6 |
| 10 | $WO_3$ | 900 | 2 | 0.6 |
| 11 | $WO_3$ | 1000 | 2 | 0.3 |
| 12 | $WO_3$ | 1150 | 2 | 0.8 |
| Comparative Example | | | | |
| C1 | — | — | — | 33.8 |

Example 2

This example is to examine the influence of the Al content on TiAl-base alloys. In this, the Al content of TiAl-base alloys was varied to 15 at. %, 47 at. % and 55 at. %. The alloys were prepared through high frequency melting in an Ar atmosphere. The weight of each ingot was 1 kg. In the same manner as in Example 1, each ingot was cut into test pieces of 10×15×2 (mm) in size. Thus were prepared materials to be treated (sample No. 13 to sample No. 24).

Next, $Cr_2O_3$ powder, $Nb_2O_5$ powder, $Ta_2O_5$ powder or $WO_3$ powder was put into an $Al_2O_3$ crucible, and each material to be treated was embedded in the powder and heated in Ar at 1000° C. for 2 hours. Thus, the materials were surface-treated in the same manner as in Example 1. The thus-treated materials were subjected to the same oxidation test as in Example 1. The data obtained are shown in Table 2.

TABLE 2

Data in Oxidation Test for Evaluating Oxidation Resistance

| Sample No. | TiAl-base Alloy | Oxide | Condition for Heat Treatment Temperature (° C.) | Condition for Heat Treatment Time (hour) | Oxidation Test Weight Increase after Oxidation ($mg/cm^2$) |
|---|---|---|---|---|---|
| Example 2 | | | | | |
| 13 | Ti-15Al | $Cr_2O_3$ | 1000 | 2 | 10.6 |
| 14 | Ti-15Al | $Nb_2O_5$ | 1000 | 2 | 12.3 |
| 15 | Ti-15Al | $Ta_2O_5$ | 1000 | 2 | 11.8 |
| 16 | Ti-15Al | $WO_3$ | 1000 | 2 | 2.2 |
| 17 | Ti-47Al | $Cr_2O_3$ | 1000 | 2 | 2.0 |
| 18 | Ti-47Al | $Nb_2O_5$ | 1000 | 2 | 2.0 |
| 19 | Ti-47Al | $Ta_2O_5$ | 1000 | 2 | 1.7 |
| 20 | Ti-47Al | $WO_3$ | 1000 | 2 | 0.3 |
| 21 | Ti-55Al | $Cr_2O_3$ | 1000 | 2 | 1.9 |
| 22 | Ti-55Al | $Nb_2O_5$ | 1000 | 2 | 1.8 |
| 23 | Ti-55Al | $Ta_2O_5$ | 1000 | 2 | 1.5 |
| 24 | Ti-55Al | $WO_3$ | 1000 | 2 | 0.2 |
| Comparative Example | | | | | |
| C2 | Ti-15Al | — | — | — | 105.6 |
| C3 | Ti-47Al | — | — | — | 33.8 |
| C4 | Ti-55Al | — | — | — | 28.9 |

From Table 2, it is understood that, even when the Al content of the matrix of the alloy is varied within the defined range, the oxidation resistance of the alloy is significantly improved if the alloy is subjected to the surface treatment of the invention.

Comparative Example 2

For comparison, the materials prepared in Example 2 but not subjected to the surface treatment were tested in the same oxidation test as in Example 2 [Sample Nos. C2 to C4]. The data obtained in the test are shown in Table 2.

Example 3

This example is to examine the improvement in the oxidation resistance of Ti-47 at. % Al containing V, Cr, Nb, Mo, Ta or W. In the same manner as in Example 1, test pieces were prepared through high frequency melting in Ar. These test pieces were surface-treated under the same condition as that for sample No. 11 in Example 1 (sample No. 25 to sample No. 30). Next, the thus-treated samples were subjected to the same oxidation test as in Example 1. The data obtained are shown in Table 3.

Comparative Example 3

For comparison, comparative materials of Ti-47 at. % Al containing V, Cr, Nb, Mo, Ta or W were prepared in the same manner as in Example 3, but these were not subjected to the surface treatment. These were tested in the same oxidation test as in Example 3. The data obtained are shown in Table 3.

The oxidation resistance of alloys containing V or Cr is generally worse than that of alloys containing neither V nor Cr. However, as in Table 3, it is known that the surface treatment of the present invention is effective even in the alloy samples containing V or Cr.

In addition, it is found that the surface treatment of the invention is also effective even in the alloy samples containing any of Nb, Mo, Ta or W.

TABLE 3

Data in Oxidation Test for Evaluating Oxidation Resistance

| Sample No. | TiAl-base Alloy | Condition for Heat Treatment Temperature (° C.) | Condition for Heat Treatment Time (hour) | Oxidation Test Weight Increase after Oxidation ($mg/cm^2$) |
|---|---|---|---|---|
| Example 3 | | | | |
| 25 | Ti-47.0 Al-1.8 V | 1000 | 2 | 0.5 |
| 26 | Ti-47.2 Al-1.8 Cr | 1000 | 2 | 0.4 |
| 27 | Ti-47.3 Al-1.9 Nb | 1000 | 2 | 0.2 |
| 28 | Ti-47.5 Al-2.0 Mo | 1000 | 2 | 0.4 |
| 29 | Ti-47.1 Al-2.0 Ta | 1000 | 2 | 0.2 |
| 30 | Ti-47.6 Al-1.8 W | 1000 | 2 | 0.2 |
| Comparative Example | | | | |
| C5 | Ti-47.2 Al-1.6 V | — | — | 45.7 |
| C6 | Ti-47.0 Al-1.5 Cr | — | — | 43.2 |
| C7 | Ti-47.1 Al-2.0 Nb | — | — | 2.8 |
| C8 | Ti-47.4 Al-2.1 Mo | — | — | 3.3 |
| C9 | Ti-47.1 Al-1.6 Ta | — | — | 3.4 |
| C10 | Ti-48.1 Al-2.0 W | — | — | 3.5 |

Example 4

This example is to examine the improvement in the oxidation resistance of the Ti-47 at. % Al alloys of Example 3 containing V, Cr, Nb, Mo, Ta or W, to which was added B. In the same manner as in Example 3, test pieces were prepared through high frequency melting in Ar. These test pieces were surface-treated in the same manner as in Example 3 (sample No. 31 to sample No. 36). Next, the thus-treated samples were subjected to the same oxidation test as in Example 3. The data obtained are shown in Table 4.

Comparative Example 4

For comparison, comparative materials of Ti-47 at. % Al—B containing V, Cr, Nb, Mo, Ta or W were prepared in the same manner as in Example 4, but these were not subjected to the surface treatment. These were tested in the same oxidation test as in Example 3 (sample No. C11 to sample No. C16). The data obtained are shown in Table 4.

TABLE 4

Data in Oxidation Test for Evaluating Oxidation Resistance

| Sample No. | TiAl-base Alloy | Condition for Heat Treatment Temperature (° C.) | Condition for Heat Treatment Time (hour) | Oxidation Test Weight Increase after Oxidation ($mg/cm^2$) |
|---|---|---|---|---|
| Example 4 | | | | |
| 31 | Ti-47.0 Al-1.6 V-2.0 B | 1000 | 2 | 0.5 |
| 32 | Ti-47.1 Al-1.5 Cr-2.1 B | 1000 | 2 | 0.4 |
| 33 | Ti-47.1 Al-2.2 Nb-1.9 B | 1000 | 2 | 0.3 |
| 34 | Ti-47.3 Al-2.1 Mo-1.8 B | 1000 | 2 | 0.4 |

TABLE 4-continued

Data in Oxidation Test for Evaluating Oxidation Resistance

| Sample No. | TiAl-base Alloy | Condition for Heat Treatment: Temperature (° C.) | Condition for Heat Treatment: Time (hour) | Oxidation Test Weight Increase after Oxidation ($mg/cm^2$) |
|---|---|---|---|---|
| 35 | Ti-47.5 Al-2.0 Ta-1.8 B | 1000 | 2 | 0.3 |
| 36 | Ti-47.3 Al-2.2 W-2.2 B | 1000 | 2 | 0.3 |
| Comparative Example | | | | |
| C11 | Ti-47.2 Al-1.6 V-2.2 B | — | — | 42.7 |
| C12 | Ti-47.0 Al-1.5 Cr-2.1 B | — | — | 40.4 |
| C13 | Ti-47.1 Al-2.0 Nb-2.1 B | — | — | 2.9 |
| C14 | Ti-47.3 Al-2.2 Mo-1.9 B | — | — | 3.8 |
| C15 | Ti-47.1 Al-1.6 Ta-1.9 B | — | — | 3.8 |
| C16 | Ti-47.3 Al-2.2 W-2.1 B | — | — | 3.9 |

The oxidation resistance of alloys containing B is generally worse than that of alloys not containing B. However, as in Table 4, it is found that the TiAl-base alloy samples containing B that had been subjected to the surface treatment of the present invention all had excellent oxidation resistance.

Moreover, the addition of B is effective in producing fine crystal particles thereby ensuring the stable room-temperature ductility of the alloys.

Example 5

[Material to be Treated]

Sponge titanium having a purity of 99.9% and aluminium having a purity of 99.99% were weighed to have a predetermined composition, and cast into a mold that had been degassed to $10^{-4}$ Torr, through high frequency melting in an Ar atmosphere, to prepare about 1 kg of ingot (Ti-47 at. % Al).

The ingot was cut into tabular test pieces of 10×15 ×2 (mm) in size. The surface of each test piece was polished with No. 1500 SiC paper, and then degreased with acetone. These test pieces are materials to be treated.

[Surface Treatment]

Using the fluidized bed furnace shown in FIG. 1, the test pieces were subjected to the surface treatment of the invention to improve their oxidation resistance.

Precisely, the fluidized bed furnace 1 is provided with an open gas-supplying duct 2 through which fluidizing gas is introduced thereinto, and has, just above the opening for the duct, a gas-dispersing plate 3 via which the inside of the furnace is partitioned into two. The top of the body of the furnace 1 is covered with a cover 4. The cover 4 is partly opened to have a duct 5 through which exhaust gas is discharged. A test piece 6, which is treated in this furnace, is hung from the cover 4. A jacket heater 7 is provided around the body of the furnace. The body of the furnace 1 is made of heat-resistant steel, and is cylindrical to have an inner diameter of 6 cm and a height of 80 cm.

First, 0.5 kg of alumina ($Al_2O_3$ ) powder of 8 to 12 mesh-pass coarse particles 8 was put on the dispersing plate 3. This is to prevent the dispersing plate from being clogged and to uniformly fluidize the treating reagent. One kg of a powdery treating reagent was put over the alumina powder. Four types of treating reagents were prepared, which were (1) a mixture of alumina powder and chromium oxide ($Cr_2O_3$) powder [for sample Nos. 37 to 39], (2) a mixture of alumina powder and niobium oxide ($Nb_2O_5$) powder [for sample Nos. 40 to 42], (3) a mixture of alumina powder and tantalum oxide ($Ta_2O_5$) powder [for sample Nos. 43 to 45], and (4) a mixture of alumina powder and tungsten oxide ($WO_3$) powder [for sample Nos. 46 to 48]. In these, the proportion of the former to the latter in terms of % by weight was 8:2 in (1), and 6:4 in (2) to (4).

Next, argon gas, which is fluidizing gas, was introduced into the furnace 1 through the gas-supplying duct 2 at a pressure of 4 $kgf/cm^2$, with which the powdery treating reagents was fluidized to form a fluidized bed 9.

Next, the cover 4 at the top of the body of the furnace 1 was removed, and the test piece 6 to be treated was hung to be in the fluidized bed 9.

Next, the body of the furnace 1 was heated with the jacket heater 7 at 900° C., 1000° C. or 1200° C. The test piece 6 was treated at the respective temperatures for from 0.5 to 8 hours, and then cooled. Thus were obtained TiAl-base alloys of Example 5 of the invention [sample Nos. 37 to 48].

Next, the thus-treated samples were taken out and their surfaces were visually observed. It was found that the treating reagent did not adhere to the samples at all and the samples had a smooth surface.

Comparative Example 5

The same samples as in Example 1 were treated in the same manner as in Example 5 except that alumina powder was used herein as the treating reagent. The treated samples were taken out and their surfaces were visually observed. It was found that the treating reagent did not adhere to the samples at all and the samples had a smooth surface.

TABLE 5

Data in Oxidation Test for Evaluating Oxidation Resistance

| Sample No. | Treating Reagent | Condition for Heat Treatment: Temperature (° C.) | Condition for Heat Treatment: Time (hour) | Oxidation Test Weight Increase after Oxidation ($mg/cm^2$) |
|---|---|---|---|---|
| Example 5 | | | | |
| 37 | 20% $Cr_2O_3$ + 80% $Al_2O_3$ | 900 | 2 | 2.7 |
| 38 | 20% $Cr_2O_3$ + 80% $Al_2O_3$ | 1000 | 2 | 2.0 |
| 39 | 20% $Cr_2O_3$ + 80% $Al_2O_3$ | 1200 | 2 | 1.7 |
| 40 | 40% $Nb_2O_5$ + 60% $Al_2O_3$ | 900 | 2 | 2.3 |
| 41 | 40% $Nb_2O_5$ + 60% $Al_2O_3$ | 1000 | 2 | 1.8 |
| 42 | 40% $Nb_2O_5$ + 60% $Al_2O_3$ | 1200 | 2 | 1.6 |
| 43 | 40% $Ta_2O_5$ + 60% $Al_2O_3$ | 900 | 2 | 1.8 |
| 44 | 40% $Ta_2O_5$ + 60% $Al_2O_3$ | 1000 | 2 | 1.9 |
| 45 | 40% $Ta_2O_5$ + 60% $Al_2O_3$ | 1200 | 2 | 1.7 |
| 46 | 40% $WO_3$ + 60% $Al_2O_3$ | 900 | 2 | 0.4 |
| 47 | 40% $WO_3$ + 60% $Al_2O_3$ | 1000 | 2 | 0.2 |
| 48 | 40% $WO_3$ + 60% $Al_2O_3$ | 1200 | 2 | 0.6 |
| Comparative Example 5 | | | | |
| C17 | $Al_2O_3$ | 900 | 2 | 9.6 |
| C18 | $Al_2O_3$ | 1000 | 2 | 7.9 |
| C19 | $Al_2O_3$ | 1200 | 2 | 6.8 |

Oxidation Test

The tabular test pieces prepared in Example 5 and Comparative Example 5 were subjected to an oxidation test, from which the oxidation resistance of the test pieces was evaluated. The oxidation test was conducted, using a resistance heating electric furnace, in which the test pieces were heated in air at 900° C. for 200 hours. Each test piece was heated in the furnace while being put in an alumina crucible, and the weight of all the heated residue including the peeled, oxidized scale was measured. From this was obtained the weight increase caused by the oxidation. Based on the weight increase, the oxidation resistance of each test piece was evaluated. The data are shown in Table 5.

As is obvious from Table 5, it is understood that the test pieces of Example 5 that were surface-treated with the treating reagent comprising any of powdery oxides of Cr, Nb, Ta or W all have significantly improved oxidation resistance.

As opposed to these, it is known that the improvement in the oxidation resistance of the test pieces of Comparative Example 5 that were surface-treated with the treating reagent of alumina powder only is poor.

Example 6

This example is to examine the influence of the Al content on TiAl-base alloys. In this, the Al content of TiAl-base alloys was varied to 15 at. %, 47 at. % and 55 at. %. The alloys were prepared through high frequency melting in an Ar atmosphere. The weight of each ingot was 1 kg. In the same manner as in Example 5, each ingot was cut into test pieces of 10×15×2 (mm) in size. Thus were prepared materials to be treated (sample No. 49 to sample No. 60).

Next, using the fluidized bed furnace of FIG. 1, the samples were subjected to the same surface treatment and the same oxidation test as in Example 5. The data obtained are shown in Table 6.

Comparative Example 6

For comparison, the samples prepared in Example 6 but not subjected to the surface treatment were tested in the same oxidation test as in Example 6. The data obtained are shown in Table 6.

TABLE 6

Data in Oxidation Test for Evaluating Oxidation Resistance

| Sample No. | Alloy Treated | Treating Reagent | Condition for Heat Treatment: Temperature (° C.) | Condition for Heat Treatment: Time (hour) | Oxidation Test Weight Increase after Oxidation ($mg/cm^2$) |
|---|---|---|---|---|---|
| Example 6 | | | | | |
| 49 | Ti-15Al | 20% $Cr_2O_3$ + 80% $Al_2O_3$ | 1000 | 2 | 3.2 |
| 50 | Ti-15Al | 40% $Nb_2O_5$ + 60% $Al_2O_3$ | 1000 | 2 | 2.6 |
| 51 | Ti-15Al | 40% $Ta_2O_5$ + 60% $Al_2O_3$ | 1000 | 2 | 2.3 |
| 52 | Ti-47Al | 20% $Cr_2O_3$ + 80% $Al_2O_3$ | 1000 | 2 | 2.0 |
| 53 | Ti-47Al | 40% $Nb_2O_5$ + 60% $Al_2O_3$ | 1000 | 2 | 2.4 |
| 54 | Ti-47Al | 40% $Ta_2O_5$ + 60% $Al_2O_3$ | 1000 | 2 | 2.3 |
| 55 | Ti-55Al | 20% $Cr_2O_3$ + 80% $Al_2O_3$ | 1000 | 2 | 2.0 |
| 56 | Ti-55Al | 40% $Nb_2O_5$ + 60% $Al_2O_3$ | 1000 | 2 | 2.2 |
| 57 | Ti-55Al | 40% $Ta_2O_5$ + 60% $Al_2O_3$ | 1000 | 2 | 2.1 |
| 58 | Ti-15Al | 40% $WO_3$ + 60% $Al_2O_3$ | 1000 | 2 | 1.5 |
| 59 | Ti-47Al | 40% $WO_3$ + 60% $Al_2O_3$ | 1000 | 2 | 0.2 |
| 60 | Ti-55Al | 40% $WO_3$ + 60% $Al_2O_3$ | 1000 | 2 | 0.2 |
| Comparative Example 6 | | | | | |
| C20 | Ti-15Al | — | — | — | 95.2 |
| C21 | Ti-47Al | — | — | — | 33.8 |
| C22 | Ti-55Al | — | — | — | 28.9 |

From Table 6, it is understood that, even when the Al content of the matrix of the alloy is varied, the oxidation resistance of the alloy is significantly improved if the alloy is subjected to the surface treatment of the invention.

Example 7

This example is to examine the improvement in the oxidation resistance of Ti-47 at. % Al containing V, Cr, Nb, Mo, Ta or W. In the same manner as in Example 5, test pieces were prepared through high frequency melting in Ar. These test pieces were surface-treated with the treating reagent (1) of Example 5 in the same manner as in Example 5 (sample No. 61 to sample No. 66). Next, the thus-treated samples were subjected to the same oxidation test as in Example 5. The data obtained are shown in Table 7.

Comparative Example 7

For comparison, comparative materials of Ti-47 at. % Al containing V, Cr, Nb, Mo, Ta or W were prepared in the same manner as in Example 7, but these were not subjected to the surface treatment. These were tested in the same oxidation test as in Example 7. The data obtained are shown in Table 7.

[Test Results in Quality Evaluation Test]

The oxidation resistance of alloys containing V or Cr is generally worse than that of alloys containing neither V nor Cr. However, as in Table 7, it is found that the surface treatment of the present invention is effective even in the alloy samples containing V or Cr.

In addition, it is found that the surface treatment of the invention is also effective even in the alloy samples containing any of Nb, Mo, Ta or W.

Moreover, the samples of Example 7 of the invention are all TiAl-base alloys with good room-temperature ductility and excellent high-temperature strength.

TABLE 7

Data in Oxidation Test for Evaluating Oxidation Resistance

| Sample No. | Alloy Treated | Condition for Heat Treatment Temperature (° C.) | Condition for Heat Treatment Time (hour) | Oxidation Test Weight Increase after Oxidation (mg/cm$^2$) |
|---|---|---|---|---|
| Example 7 | | | | |
| 61 | Ti-47.1 Al-1.6 V | 1000 | 2 | 0.4 |
| 62 | Ti-47.3 Al-1.5 Cr | 1000 | 2 | 0.4 |
| 63 | Ti-47.3 Al-2.3 Nb | 1000 | 2 | 0.2 |
| 64 | Ti-47.3 Al-2.2 Mo | 1000 | 2 | 0.2 |
| 65 | Ti-47.3 Al-2.1 Ta | 1000 | 2 | 0.2 |
| 66 | Ti-47.3 Al-2.2 W | 1000 | 2 | 0.1 |
| Comparative Example 7 | | | | |
| C23 | Ti-47.2 Al-1.6 V | — | — | 45.7 |
| C24 | Ti-47.0 Al-1.5 Cr | — | — | 43.2 |
| C25 | Ti-47.1 Al-2.0 Nb | — | — | 2.4 |
| C26 | Ti-47.4 Al-2.1 Mo | — | — | 3.7 |
| C27 | Ti-47.1 Al-1.6 Ta | — | — | 3.6 |
| C28 | Ti-48.1 Al-2.0 W | — | — | 3.9 |

Example 8

This example is to examine the improvement in the oxidation resistance of the Ti-47 at. % Al alloys of Example 7 containing V, Cr, Nb, Mo, Ta or W, to which was added B. In the same manner as in Example 7, test pieces were prepared through high frequency melting in Ar. These test pieces were surface-treated with the treating reagent (1) of Example 5 in the same manner as in Example 7 (sample No. 67 to sample No. 72). Next, the thus-treated samples were subjected to the same oxidation test as in Example 7. The data obtained are shown in Table 8.

Comparative Example 8

For comparison, comparative materials of Ti-47 at. % Al—B containing V, Cr, Nb, Mo, Ta or W were prepared in the same manner as in Example 8, but these were not subjected to the surface treatment. These were tested in the same oxidation test as in Example 7. The data obtained are shown in Table 8.

TABLE 8

Data in Oxidation Test for Evaluating Oxidation Resistance

| Sample No. | Alloy Treated | Condition for Heat Treatment Temperature (° C.) | Condition for Heat Treatment Time (hour) | Oxidation Test Weight Increase after Oxidation (mg/cm$^2$) |
|---|---|---|---|---|
| Example 8 | | | | |
| 67 | Ti-47.1 Al-1.6 V-2.3 B | 1000 | 2 | 0.4 |
| 68 | Ti-47.3 Al-1.5 Cr-2.2 B | 1000 | 2 | 0.3 |
| 69 | Ti-47.3 Al-2.3 Nb-1.9 B | 1000 | 2 | 0.2 |
| 70 | Ti-47.3 Al-2.2 Mo-1.7 B | 1000 | 2 | 0.2 |
| 71 | Ti-47.3 Al-2.1 Ta-1.9 B | 1000 | 2 | 0.2 |
| 72 | Ti-47.3 Al-2.2 W-2.2 B | 1000 | 2 | 0.1 |

TABLE 8-continued

Data in Oxidation Test for Evaluating Oxidation Resistance

| Sample No. | Alloy Treated | Condition for Heat Treatment Temperature (° C.) | Condition for Heat Treatment Time (hour) | Oxidation Test Weight Increase after Oxidation (mg/cm$^2$) |
|---|---|---|---|---|
| Comparative Example 8 | | | | |
| C29 | Ti-47.2 Al-1.6 V-2.2 B | — | — | 42.7 |
| C30 | Ti-47.0 Al-1.5 Cr-2.1 B | — | — | 40.4 |
| C31 | Ti-47.1 Al-2.0 Nb-2.1 B | — | — | 2.2 |
| C32 | Ti-47.4 Al-2.2 Mo-1.9 B | — | — | 3.6 |
| C33 | Ti-47.1 Al-1.6 Ta-1.9 B | — | — | 3.2 |
| C34 | Ti-48.1 Al-2.2 W-2.1 B | — | — | 3.5 |

The oxidation resistance of alloys containing B is generally worse than that of alloys not containing B. However, as in Table 8, it is found that the TiAl-base alloy samples containing B that had been subjected to the surface treatment of the present invention all had excellent oxidation resistance.

Moreover, the addition of B is effective in producing fine crystal particles thereby ensuring the stable room-temperature ductility of the alloys.

INDUSTRIAL APPLICABILITY

The present invention provides TiAl-base alloys with significantly improved oxidation resistance that is superior to the oxidation resistance of a heat-resistant Ni-base alloy, Inconel 713C. The TiAl-base alloys of the present invention is resistant to high temperatures of 900° C. or higher. Therefore, the TiAl-base alloys of the invention are applicable to materials for turbo-chargers for cars and also as materials for gas turbines in power plants and materials for jet engines.

What is claimed is:

1. A product comprising a substrate comprising a TiAl-base alloy; and a surface part formed on the substrate, said product produced by introducing into a fluidized bed furnace a treating reagent consisting essentially of an oxide of at least one element selected from the group consisting of niobium (Nb), tantalum (Ta), chromium (Cr) and tungsten (W), and a powdery refractory;

introducing a fluidizing gas thereinto to fluidize the treating reagent;

disposing a TiAl-base alloy, which has an Al content of from 15 at. % to 55 at. % in the fluidized bed furnace; and heating the TiAl-base alloy in an inert gas at a temperature of from 400° C. to 1450° C.

2. The product as claimed in claim 1, wherein the element comprises tungsten (W).

3. The product as claimed in claim 1, wherein the TiAl-base alloy contains at least one Group Va or Group VIa element in a total amount of from 0.1 at. % to 10 at. %.

4. The product as claimed in claim 1, wherein the TiAl-base alloy further comprises boron in an amount of from 1 at. % to 10 at. %.

5. The product as claimed in claim 1, wherein the TiAl-base alloy has an oxide layer comprising Al—O between the substrate and the surface part.

6. The product as claimed in claim 5, wherein the TiAl-base alloy contains at least one Group Va or Group VIa element in a total amount of from 0.1 at. % to 10 at. %.

7. The product as claimed in claim 5, wherein the TiAl-base alloy further contains boron in an amount of from 1 at. % to 10 at. %.

8. The product as claimed in claim 1, wherein the surface part comprises a composite oxide comprising Al—W—O.

9. The product as claimed in claim 1, wherein the surface part comprises a composite oxide comprising Al—W—O.

10. The product as claimed in claim 9, wherein the TiAl-base alloy has an oxide layer comprising Al—O between the substrate and the surface layer part.

11. The product as claimed in any one of claims 8 to 10, wherein the composite oxide contains tungsten (W) in an amount of from 0.5at. % to 50 at. %.

12. The product as claimed in any one of claims 8 to 10, wherein the TiAl-base alloy contains at least one Group Va or Group VIa element in a total amount of from 0.1 at. % to 10 at. %.

13. The product as claimed in any one of claims 8 to 10, wherein the TiAl-base alloy further comprises boron in an amount of from 1 at. % to 10 at. %.

14. The product as claimed in claim 1, wherein the surface part has been modified into an oxide layer comprising Al—O.

15. The product as claimed in claim 14, further comprising an oxide of W on the surface of the oxide layer.

16. The product as claimed in claim 1, wherein the surface part comprises $Al_2O_3$.

17. The product as claimed in claim 1, wherein the surface part has been modified into an oxide layer comprising $Al_2O_3$.

18. A method for producing the product of claim 1, comprising:

introducing into a fluidized bed furnace a treating reagent consisting essentially of an oxide of at least one element selected from the group consisting of niobium (Nb), tantalum (Ta), chromium (Cr) and tungsten (W), and a powdery refractory;

introducing a fluidizing gas thereinto to fluidize the treating reagent;

disposing a TiAl-base alloy material having an Al content of from 15 at. % to 55 at. % in the fluidized bed furnace; and heating the TiAl-base alloy material in an inert gas at a temperature of from 400° C. to 1450 ° C.

19. The method as claimed in claim 18, wherein the TiAl-base alloy contains at least one Group Va and Group VIa element in a total amount of from 0.1 at. % to 10 at. %.

20. The method as claimed in claim 18, wherein the element comprises tungsten (W).

21. The method as claimed in claims 18 or 20, wherein the TiAl-base alloy further contains boron in an amount of from 1 at. % to 10 at. %.

22. The method as claimed in claim 18, wherein the surface part comprises $Al_2O_3$.

* * * * *

UNITED STATES PATENT AND TRADEMARK OFFICE

CERTIFICATE OF CORRECTION

PATENT NO. : 6,410,154 B2
DATED : June 25, 2002
INVENTOR(S) : Hiroyuki Kawaura et al.

It is certified that error appears in the above-identified patent and that said Letters Patent is hereby corrected as shown below:

Title page,
Item [57], ABSTRACT,
Line 14, "resistance." should read -- resistance. The TiA1-base alloys of the invention have significantly improved oxidation resistance and are resistant to heat at high temperatures of 900°C or higher. Therefore, the alloys are usable as materials for turbo-chargers for cars, those for gas turbines in power plants and those for jet engines. --.

Column 21,
Line 16, "from 0.5at. %" should read -- from 0.5 at. % --.

Signed and Sealed this

Twenty-fifth Day of March, 2003

JAMES E. ROGAN
*Director of the United States Patent and Trademark Office*